US008151602B2

(12) United States Patent
Zardetto

(10) Patent No.: US 8,151,602 B2
(45) Date of Patent: Apr. 10, 2012

(54) TOP-LOADING CLOTHES WASHING MACHINE WITH LID ENTERLOCK MEANS

(75) Inventor: Ennio Zardetto, Vazola (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 370 days.

(21) Appl. No.: 12/066,556

(22) PCT Filed: Sep. 22, 2006

(86) PCT No.: PCT/EP2006/009206

§ 371 (c)(1),
(2), (4) Date: May 5, 2008

(87) PCT Pub. No.: WO2007/039135

PCT Pub. Date: Apr. 12, 2007

(65) Prior Publication Data

US 2008/0223086 A1 Sep. 18, 2008

(30) Foreign Application Priority Data

Sep. 29, 2005 (EP) ..... 05108996

(51) Int. Cl.
*D06F 37/10* (2006.01)
*D06F 39/14* (2006.01)

(52) U.S. Cl. ..... 68/142; 68/3 R; 68/12.26; 68/196

(58) Field of Classification Search ..... 68/142, 68/3 R, 12.26, 196
See application file for complete search history.

(56) References Cited

U.S. PATENT DOCUMENTS

| | | | | |
|---|---|---|---|---|
| 5,469,593 | A * | 11/1995 | Cuthbert et al. | 8/159 |
| 2003/0061841 | A1 * | 4/2003 | Nakamura et al. | 68/12.26 |
| 2004/0231062 | A1 | 11/2004 | Sharrow | |

FOREIGN PATENT DOCUMENTS

| | | |
|---|---|---|
| EP | 0681050 | 11/1995 |
| EP | 1298242 | 4/2003 |
| GB | 1550869 | 8/1979 |
| GB | 2043704 | 10/1980 |
| JP | 2003311094 | 11/2003 |

OTHER PUBLICATIONS

Machine translation of JP2003-311094 (May 2003).*

* cited by examiner

*Primary Examiner* — Michael Barr
*Assistant Examiner* — Benjamin Osterhout
(74) *Attorney, Agent, or Firm* — Pearne & Gordon LLP

(57) ABSTRACT

Top-loading clothes washing machine, including a wash tub, inside which there is arranged a cylindrical drum adapted to rotate about a horizontal axis thereof. The drum is provided with an access or loading port situated on a portion of the cylindrical side surface thereof, and at least a flap for closing/opening the drum access port. There is also provided a top lid adapted to close the aperture into the wash tub from above, and hinged with an edge portion thereof on the upper rear edge portion of the outer casing of the machine. The machine is provided with interference means applied on to a portion of the machine comprised between the drum and the top lid, and adapted to be rotated upwards when the drum flap is opened, thereby interfering with the top lid. As a result, the interference means will act to make it impossible for the top lid to be closed if the drum flap is not duly closed.

11 Claims, 7 Drawing Sheets

TOP-LOADING CLOTHES WASHING MACHINE WITH LID ENTERLOCK MEANS

BACKGROUND OF THE INVENTION

1. Field of the Invention

The present invention refers to an improved kind of top-loading clothes washing machine, preferably of the type intended for use in households, provided with a particular arrangement aimed at locking the top lid of the machine in its opened, i.e. raised state.

2. Description of Related Art

Largely known in the art are currently top-loading clothes washing machines that comprise a horizontally lying cover lid on top, which is adapted to by raised from the front side through a rotary motion about proper hinging pins provided in the rear upper portion of the machine. By lifting this cover lid, access is gained into a hopper, or funnel-like loading configuration, which opens into an aperture on top of the washing tub, or outer drum, which in turn opens onto the cylindrical side wall of the rotating drum; on a portion of said cylindrical wall of the rotating drum there is provided the loading aperture, or port, providing access into the rotating drum, through which the clothes to be washed are introduced in the drum.

This access port is of course adapted to be closed by means of one or two lids (internal flaps), so as to enable the perfectly cylindrical, continuous shape of the side wall of the drum to be restored, in view of preventing the washload from being projected out of the drum as this starts rotating.

These machines are provided with special safety devices concerning the operation thereof, which are practically activated by the position of the top or cover lid of the machine.

Quite well known in the art are in particular the devices (lid or door interlock devices), along with the related operating mode, which prevent the top cover lid from being capable of being opened as the washload holding drum is rotating, especially during the spin-extraction high-speed rotating phases thereof, as this is for example illustrated in the patent applications Nos. JP 2001089366, JP 2000313615 and JP 2000000340528.

Known from the disclosures in further patent documents, eg. JP 2003148474, are other means adapted to enable said safety means, i.e. lid interlock devices, to be automatically released upon completion of the washing cycle, when the drum has stopped rotating.

None of these patents, however, discloses top-loading clothes washing machines that are equipped with safety means adapted to prevent the machine from being able to operate when the top lid thereof, i.e. the one that provides access into the hopper, or loading funnel, is closed, i.e. let down into closed position without first having the internal flaps closing the loading port in the side wall of the rotating drum duly closed.

Now, this is a quite possible and frequent occurrence, as a vast experience made in the field actually tells, in particular when these machines are used by people who are not very familiar therewith or simply careless.

When such occurrence takes place, i.e. when the top lid is closed without having first closed the internal flaps of the drum, and the machine is started operating, this unavoidably causes the well known accident to take place, in which a still open internal flap comes into collision with the edge of said aperture of the washing tub, and this leads to either one of two serious consequences, of which:

the most serious one is certainly represented by both the rotating drum and the tub suffering damages requiring total repair, which—owing to the overall costs thereof—turns generally out as being economically unworthy when compared with the cost of purchasing a new machine; and the less serious one is represented by the drum getting locked, i.e. jammed, so that the driving belt of the drum starts slipping until it eventually breaks down, causing a failure that can be solely done away with by having the belt replaced by a repairman.

Known from the disclosure in EP 1 298 242 A1 is a top-loading clothes washing machine that is provided with both a lid to close the loading port in the drum, and a lid to close the upper portion of the wash tub, which enables access to be gained to the loading port of the drum when it is rotated in an upward facing position, i.e. on top. This solution is certainly more effective in making it difficult for the top lid of the machine to be closed, i.e. let down, if the flap of the drum has been left open, owing to the fact that, if this flap remains in its opened position, the same is necessarily true also for the lid closing the aperture of the tub, and said circumstance is certainly more visible, i.e. more clearly and readily perceived. On the other hand, providing such lid to close the tub implies production costs and complications that are scarcely acceptable in a highly competitive industry as the electric home appliance one.

BRIEF SUMMARY OF THE INVENTION

It would therefore be desirable, and it is actually a main object of the present invention to provide a top-loading clothes washing machine that is provided with means adapted to prevent the top lid from being able to be closed if the internal flap of the drum has not been duly closed first, without this requiring the machine to be additionally equipped with a lid to close the tub in view of achieving such safety effect.

According to the present invention, this aim is reached in a top-loading clothes washing machine incorporating the characteristics and features as recited in the appended claims.

BRIEF DESCRIPTION OF THE DRAWINGS

Anyway, features and advantages of the top-loading clothes washing machine according to the present invention will be more readily understood from the description that is given below by way of non-limiting example with reference to the accompanying drawings, in which.

DETAILED DESCRIPTION OF THE INVENTION

Figure 1:
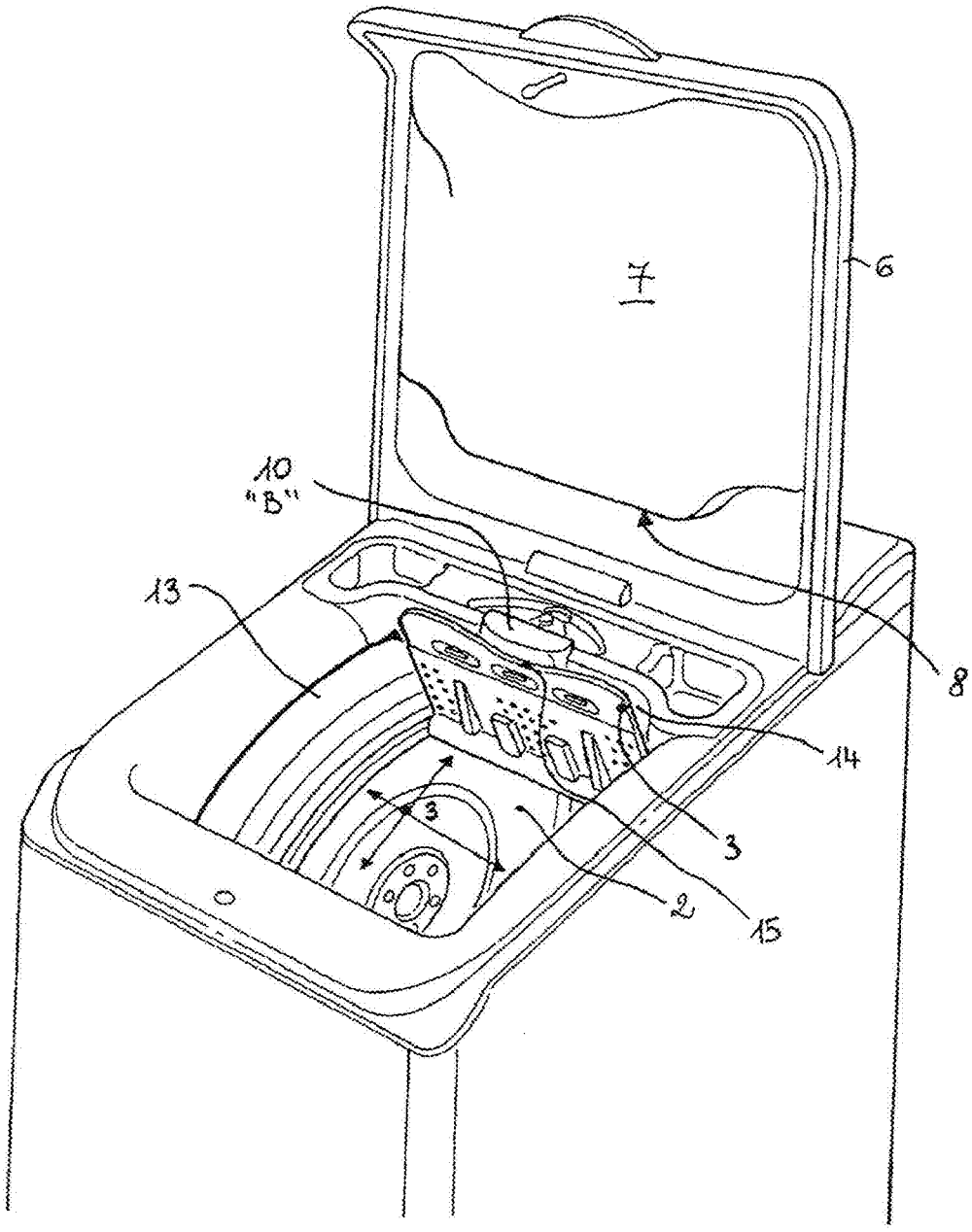
FIG. 1 is a symbolical perspective view of the upper portion of a top-loading clothes washing machine with the top lid in a raised and the flap of the loading port of the drum opened, and with the device according to the present invention in its operative state.

With reference to FIG. 1, in a prior-art top-loading clothes washing machine there is provided a wash tub 1, inside which there is arranged a drum 2 adapted to hold the clothes to be washed and rotating about a horizontal axis X.

In a conventional manner, this rotating drum is provided with an access port 3 situated in a portion of the cylindrical side surface thereof and adapted to be closed by means of a flap 5, which is hinged on an edge of said access port, wherein the possibility also exists for the drum to be provided with two mutually opposing lids used to close such access port thereof. However, such configuration would by no means affect or imply any substantial modification of either the present invention or the description being given thereof.

This prior-art machine is further provided with a top or cover lid 6 adapted to close the upper internal portion of the machine from above, wherein this upper internal portion of the machine is provided in the form of a hopper or funnel-like configuration 13 leading into said access port 3 of the drum. Such top lid 6 is hinged on a cross portion of the upper rear surface of the outer casing of the machine.

According to the present invention, between said drum 2 and the top lid 6 there are arranged interference means, which are preferably comprised of a member 10 provided to partially rotate, or swing, about a pin 11 associated to an edge of said rotating or swinging member, and provided integrally with, i.e. firmly joined to the rear wall 14 of said hopper 13.

Figure 2:
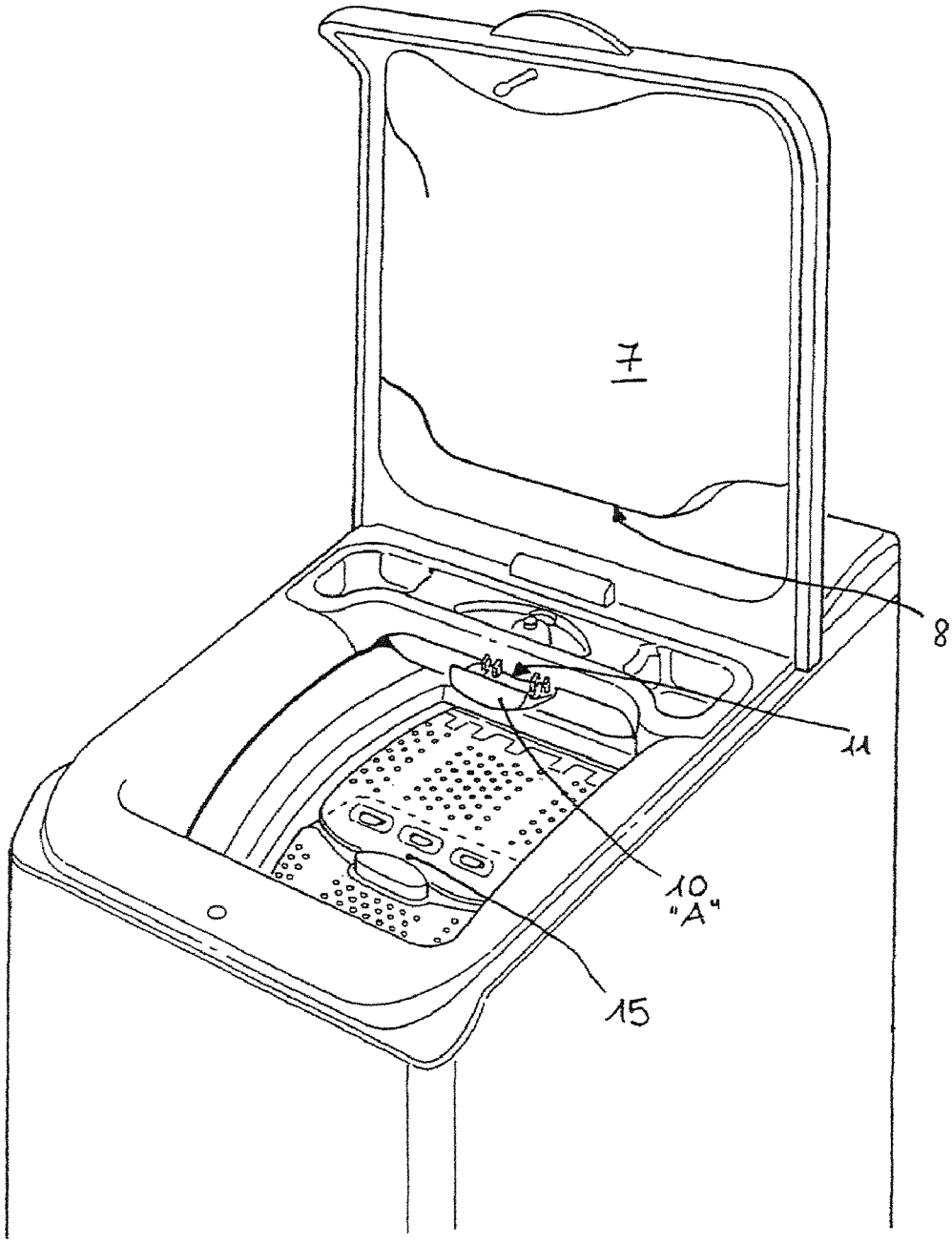
FIG. 2 is a view of the machine shown in FIG. 1, in which the flap of the drum is however closed and the device according to the present invention in its resting, i.e. inoperative state.

This rotating member is of course adapted to move into and take a plurality distinct position about said pin 11; in particular, it moves into a first lowered position A (FIGS. 2, 4, 5), in which it is retracted inside the hopper and does not interfere with any other member or part of the machine, and into a second raised position B (FIGS. 1, 3, 6, 7). This second raised position is taken by said member when the afore-cited flap 5 used to close the loading port of the drum is raised so as to gain access into the same drum; in this condition, said flap therefore comes with an outer portion or side thereof 15 into contact with said rotating member 10 and, as a result, interferes therewith (FIGS. 1, 2, 3, 6); the movement of this flap and the movement of said rotating member are in this way so mutually organized as to cause said flap being raised by the operator to automatically and simultaneously raise the rotating member 10, the outer side 15 of which is therefore caused to rotatably displace towards the top lid 6 that had of course been previously brought into its opened position.

Basically, therefore, opening the drum flap 5 causes the member 10 to rotatably raise so as to move into such a position as to have the outer side 15 thereof interfering with a possible closing or lowering movement of the top lid 6, thereby preventing the latter from being able to do so.

It is at this point fully apparent that the inventive solution practically prevents the top lid 6 of the machine from being closed if the internal flap 5 of the drum has not been first duly closed. Therefore, should the operator attempt to close the top lid 6 of the machine without having first closed the internal flap of the drum, it will be positively prevented from doing so, while being at the same time cautioned on the necessity for him/her to first close the flap of the drum.

This ultimately enables the desired result, i.e. preventing machine operation from being started when the drum flap is still open, to be effectively attained.

Figure 3:
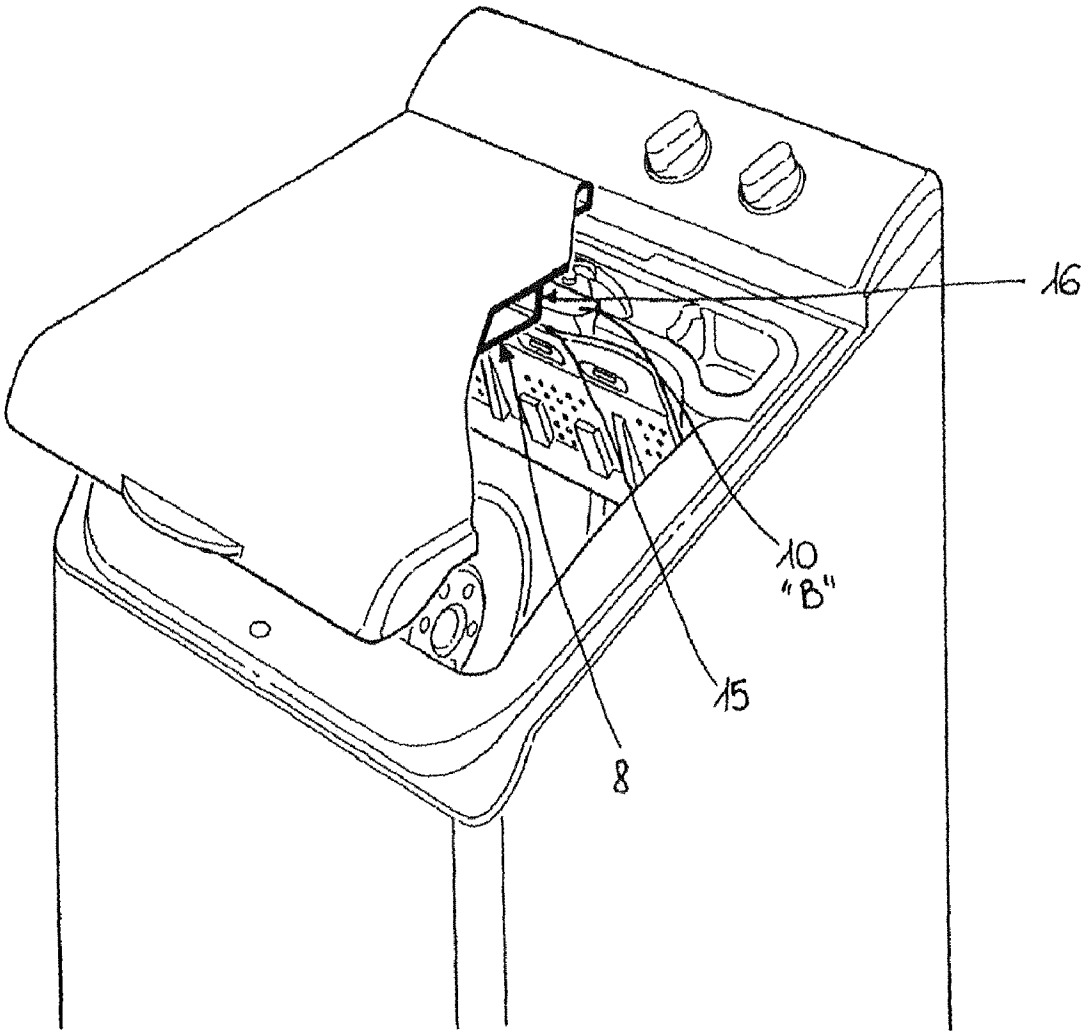
FIG. 3 is a view of the machine shown in FIG. 1, in which the flap of the drum is open and the top lid is half-closed, the device according to the present invention being in its operative state.
Figure 4:
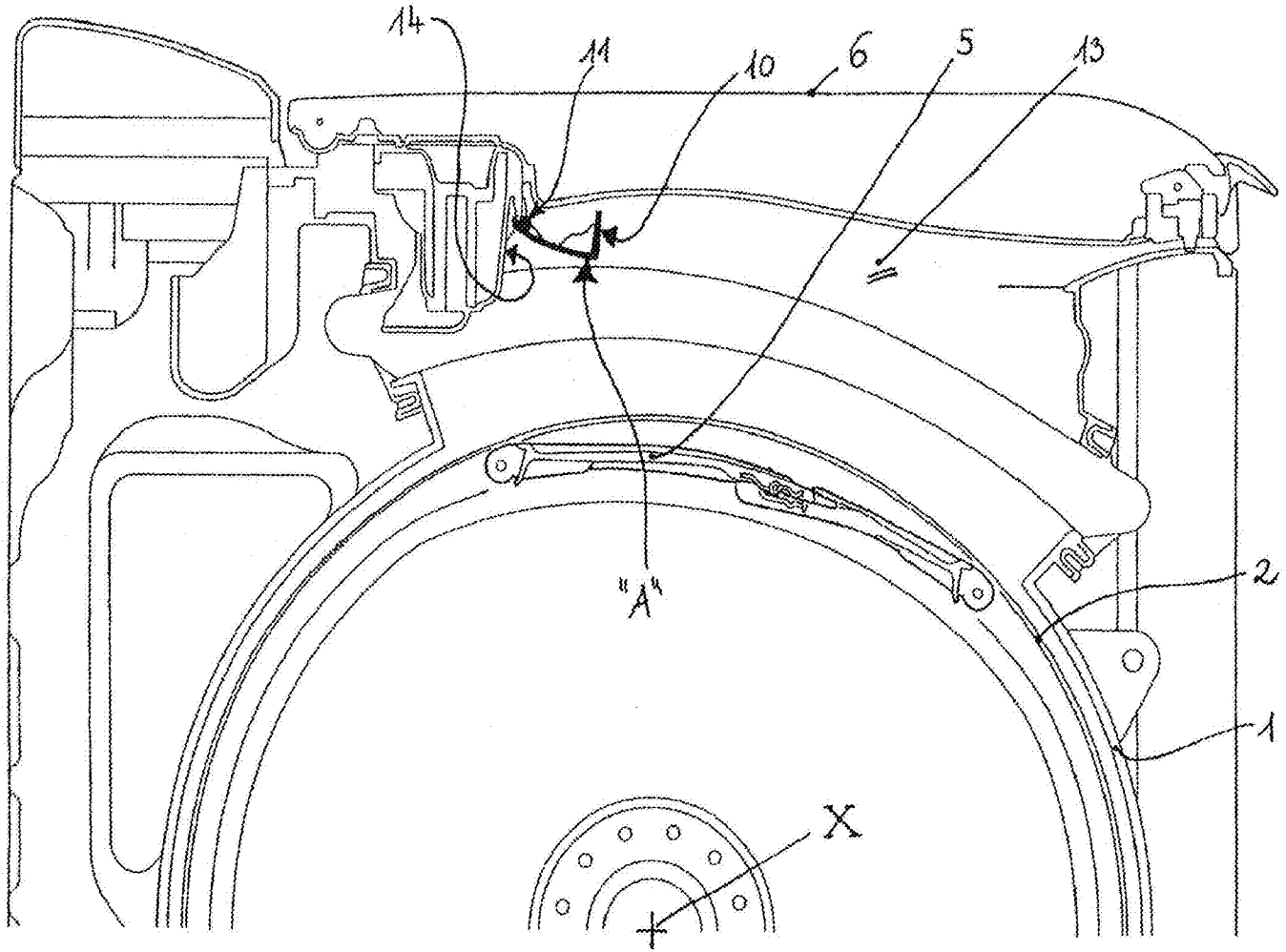
FIG. 4 is an elevational side cross-sectional view of the machine according to the present invention, in which both the flap of the drum and the top lid of the machine are closed.
Figure 5:
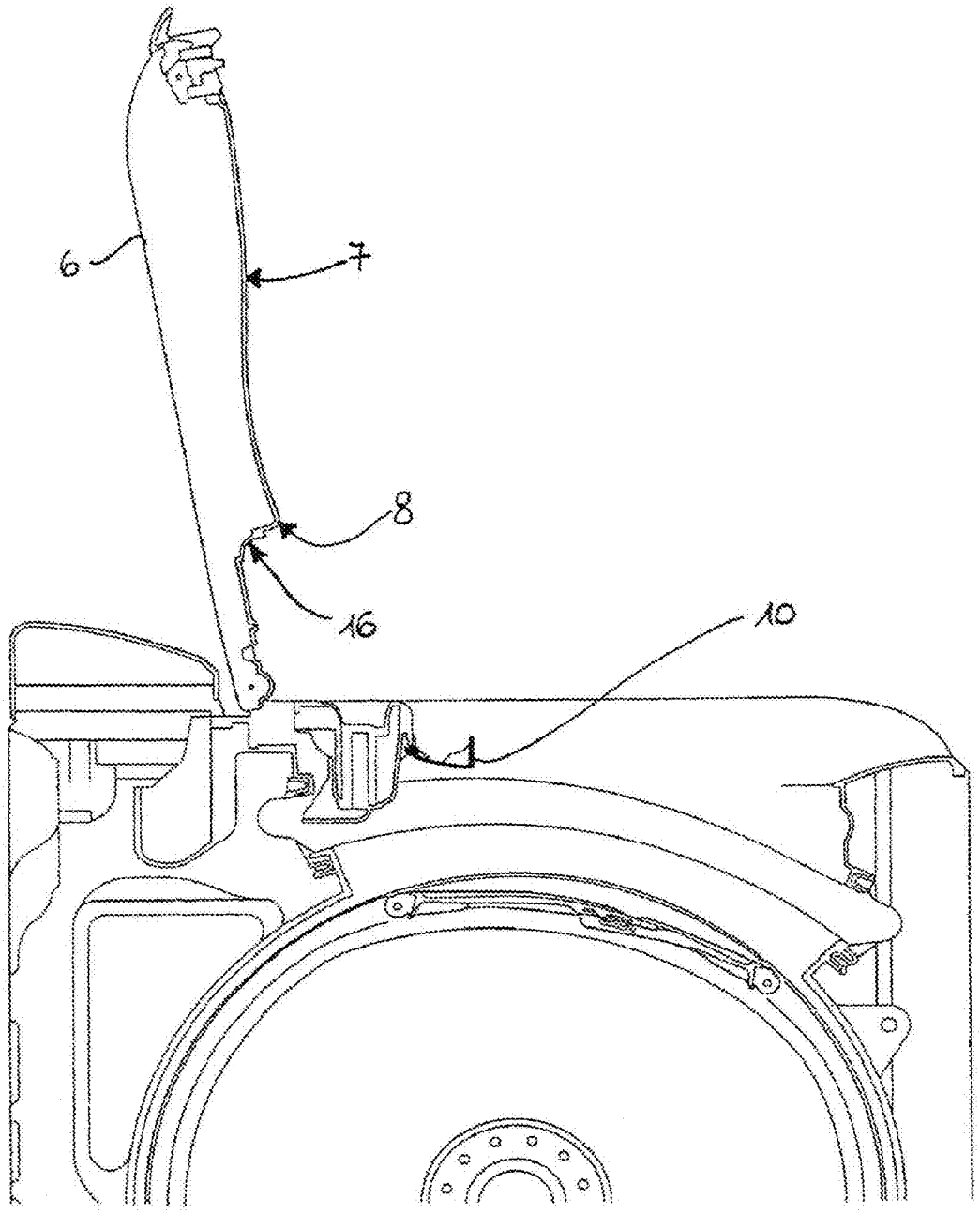
FIG. 5 is an elevational side cross-sectional view of the machine according to the present invention, in a state that substantially corresponds to the one illustrated in FIG. 2.
Figure 6:
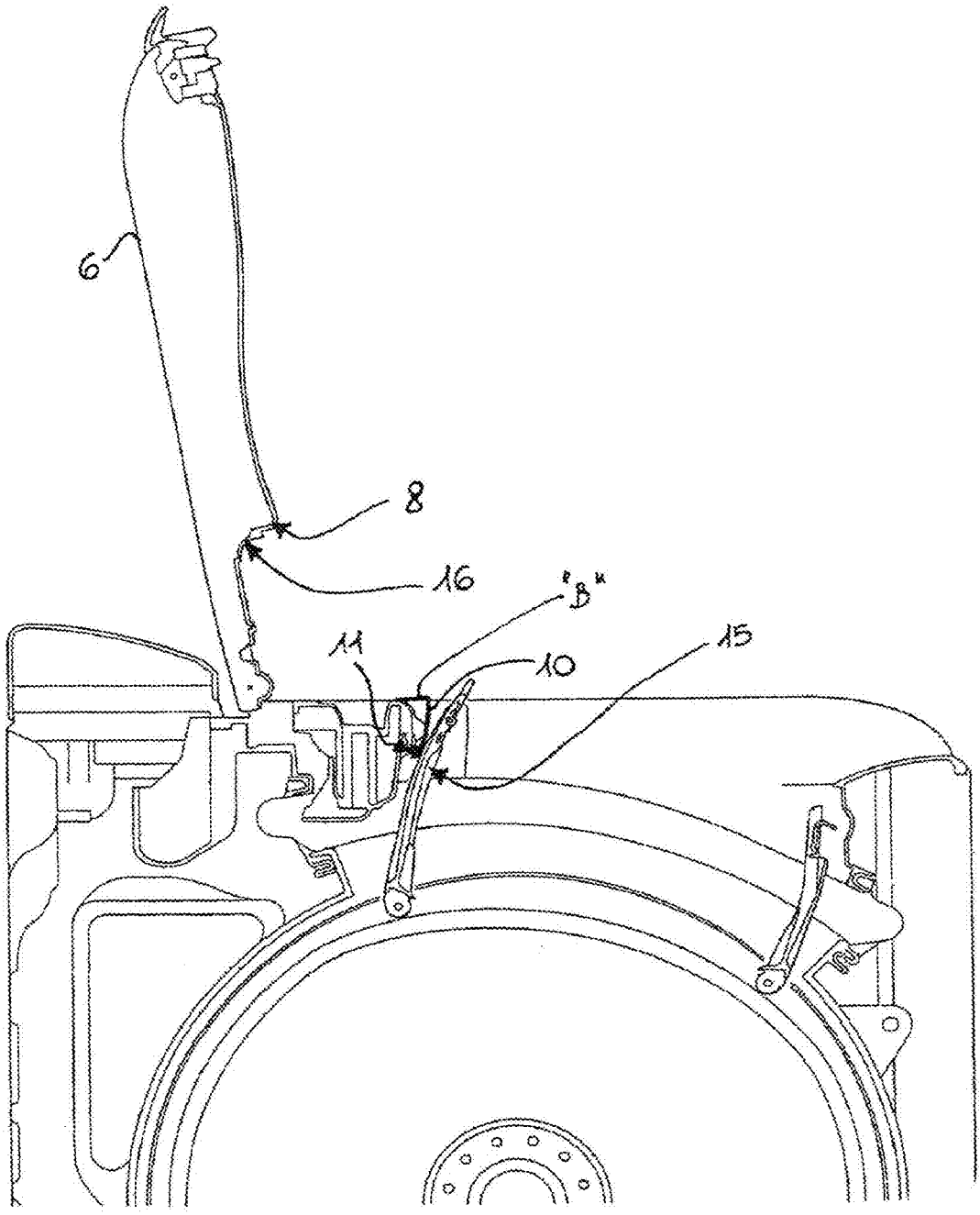
FIG. 6 is an elevational side cross-sectional view of the machine according to the present invention, in a state that substantially corresponds to the one illustrated in FIG. 1.

In an advantageous manner, the inventive solution also allows for a further useful improvement, which consists in providing the inner surface 7 of the top lid 6 with a relief 8, which substantially protrudes downwards when said top lid 6 is open (see FIGS. 1, 3, 5).

This is effective in enabling a recess 16 to be created—in the lower portion of the lid when the latter is open—between said relief 8 and the inner surface of the same lid 6 (see FIGS. 1, 2, 3, 6, 7).

Figure 7:
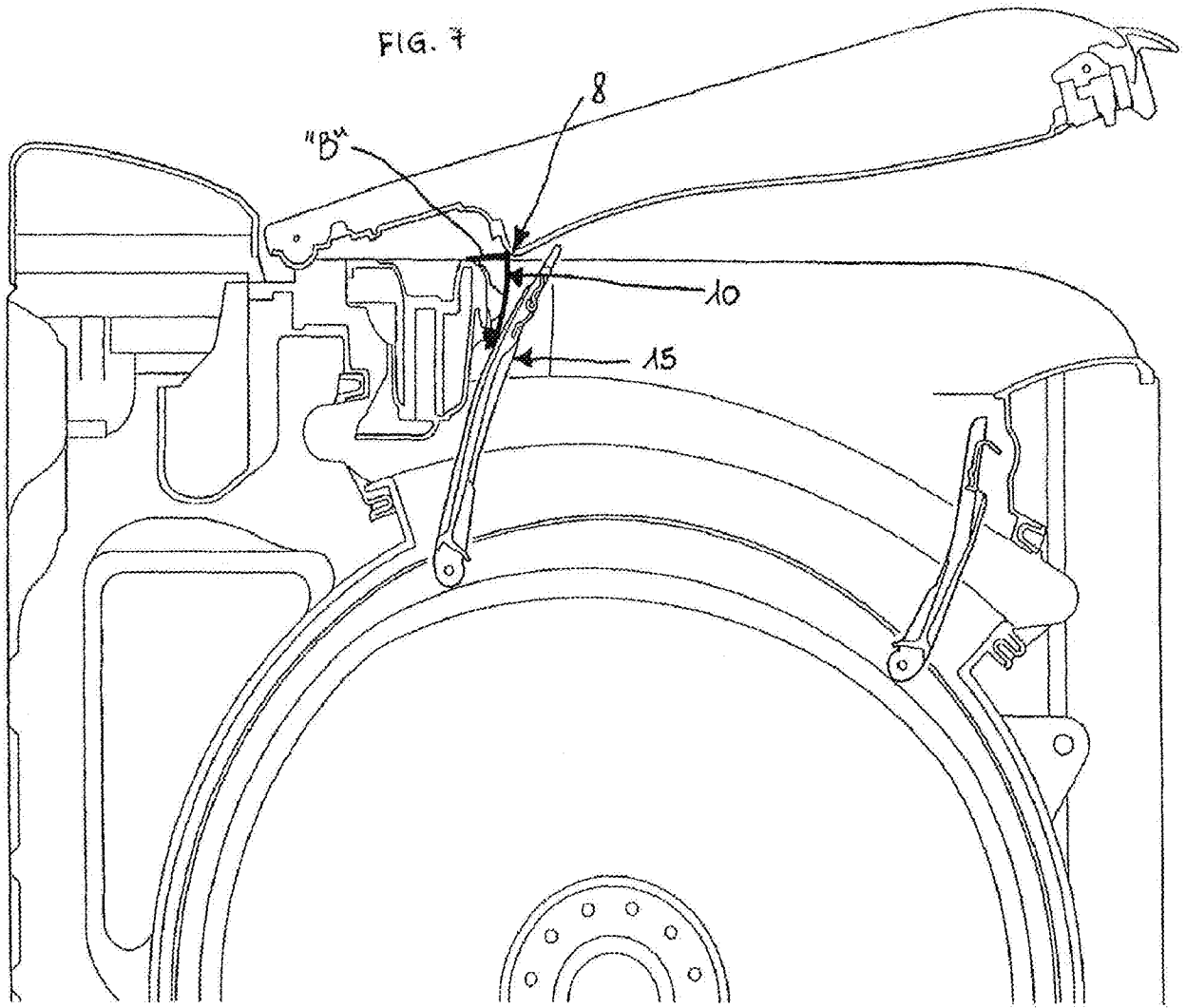
FIG. 7 is an elevational side cross-sectional view of the machine according to the present invention, in a state that substantially corresponds to the one illustrated in FIG. 3.

This relief 8 is so shaped as to enable said outer side 15 to be raised and move into engaging said recess 16—as best shown in FIGS. 3 and 7—when, with the top lid 6 is open, also the flap 5 of the loading port of the drum is in turn opened.

Such circumstance enables the top lid 6 to be positively and effectively hindered and prevented from being closed in the case that the flap of the drum is left inadvertently open, so as to avoid bumps, mutual slips of parts, as well as force the operator to actually close the flap of the drum with an intentional, specifically intended action, without which said rotating member 10 would not be able to move into its lowered position and, as a result, the top lid of the machine would not close down.

What is claimed is:

1. Top-loading clothes washing or combined washing and drying machine, comprising:

a wash tub, inside which there is arranged a cylindrical drum configured to rotate about the horizontal axis thereof, said drum being provided with an access port situated on a portion of a cylindrical side surface thereof, at least one flap for closing/opening said drum access port, capable of being raised and hinged on to an edge portion of said access port, a top lid configured to close said access port from above, and hinged with an edge portion thereof on the upper rear edge portion of the outer casing of the machine, and an interference member applied on to a portion of said machine between said drum and said top lid, said interference member is configured to move into and take a first lowered position in which the interference member does not interfere with the closing movement of said top lid when said at least one flap of the drum is closed onto said access port thereof, and wherein said at least one flap comes into contact with said interference member and causes said interference member to automatically move up and take a second raised position in which the interference member interferes with the closing movement of said top lid, when said at least one flap of the drum is raised from said access port thereof.

2. Machine according to claim 1, wherein said interference member is configured to move into and take a second raised position when said at least one access flap of the drum is raised from said access port thereof.

3. Machine according to claim 2, wherein in said second raised position thereof, said interference member takes an interference position thereof.

4. Machine according to claim 1, wherein said interference member is provided with pin, preferably applied on to an edge portion thereof, configured to allow said interference member to perform a rotary (swinging) movement on a vertical plane between said first lowered position and said second raised position thereof.

5. Machine according to claim 1, wherein the inner surface of said top lid is provided with a relief configured to engage, with a recess thereof, said interference member when the interference member is raised in said second raised position thereof.

6. Machine according to claim 3, wherein that said machine is provided with a loading hopper for the clothes to be introduced in the drum, said hopper being firmly joined or integral with the structure of the same machine and arranged in a funnel-like configuration above said loading port, when the latter is turned so as to face upwards, and in that said pin is applied on to the rear surface of said loading hopper.

7. Machine according to claim 1, further comprising a loading hopper with a funnel-like configuration leading into the access port.

8. Machine according to claim 7, wherein the top lid is configured to close the loading hopper from above.

9. Machine according to claim 7, wherein the interference member is retracted inside the hopper in the first lowered position.

10. Machine according to claim 7, wherein the interference member is rotatably associated with the loading hopper.

11. Machine according to claim 1, wherein the interference member only partially covers the at least one flap when the interference member is in the first lowered position, such that the access port is not blocked by the interference member.

* * * * *